United States Patent [19]

Kasahara et al.

[11] Patent Number: 5,075,188

[45] **Date of Patent: * Dec. 24, 1991**

[54] SELENIUM ELECTROPHOTOGRAPHIC PHOTORECEPTOR

[75] Inventors: Masahiko Kasahara; Tatsuo Tanaka; Mitsuru Narita, all of Matsumoto, Japan

[73] Assignee: Fuji Electric Co., Ltd., Japan

[ * ] Notice: The portion of the term of this patent subsequent to Jan. 2, 2007 has been disclaimed.

[21] Appl. No.: 472,626

[22] Filed: Jan. 30, 1990

Related U.S. Application Data

[63] Continuation-in-part of Ser. No. 314,433, Feb. 22, 1989.

[30] Foreign Application Priority Data

Jan. 30, 1989 [JP] Japan ..... 1-20375

[51] Int. Cl.[5] ..... G03G 5/14

[52] U.S. Cl. ..... 430/58; 430/66; 430/85

[58] Field of Search ..... 430/58, 65, 66, 67, 430/85

[56] References Cited

U.S. PATENT DOCUMENTS

| | | | |
|---|---|---|---|
| 4,255,505 | 3/1981 | Hanada et al. | 430/65 |
| 4,770,965 | 9/1988 | Fender et al. | 430/66 |
| 4,891,290 | 1/1990 | Narita | 430/65 |

*Primary Examiner*—John Goodrow

*Attorney, Agent, or Firm*—Brumbaugh, Graves, Donohue & Raymond

[57] ABSTRACT

The present invention provides a seleniumn electrophotographic photoreceptor comprising a laminate of a conductive base, a carrier transportaion layer consisting of amorphous selenium or an amorphous Se-Te alloy, a carrier generation layer consisting of an amorphous Se-Te alloy containing 20 to 50 wt % of Te, and an overcoat layer composed of two layers consisting of Se-As alloys having different arsenic concentrations and different thickenesses. In one embodiment of the invention, the lower overcoat layer contains 2–10% by weight arsenic while the upper overcoat layer contains 10–30% by weight arsenic. In another embodiment of the invention, the thickness of the upper overcoat layer is greater than that of the lower overcoat layer but not more than 8 μm.

5 Claims, 2 Drawing Sheets

SELENIUM ELECTROPHOTOGRAPHIC PHOTORECEPTOR

This application is a continuation-in-part of U.S. application Ser. No. 314,433 filed Feb. 22, 1989.

BACKGROUND OF THE INVENTION

The present invention relates to a selenium electrophotographic laminate photoreceptor which is used in ordinary copying machines and optical printers having light-emitting diodes, laser diodes, gas lasers, or the like as light sources.

In making hard copies, optical printers have been widely used owing to high copying speeds and good image quality. The wavelength of light from the light source of such an optical printer is in the range of 660 to 800 nm, namely, a long wavelength range. An electrophotographic photoreceptor with a charge generating layer made of a high-concentration Te-Se alloy containing 20 to 50 wt % of tellurium so as to have excellent electrophotographic properties in a long wavelength range is disclosed in applicants' Japanese Patent Laid-Open No. 278858/1986, and has been put to practical use.

The printing durability of such a photoreceptor having a carrier generating layer of a high-concentration Te-Se alloy is determined by the overcoat layer. It is known that in order to enhance the printing durability, a selenium arsenic alloy with an increased arsenic concentration is used for the overcoat layer. However, when the arsenic concentration is increased, the thermal expansion coefficient of the overcoat layer is reduced, as shown in FIG. 2, so that the difference in the thermal expansion coefficient between the surface and the base layer of a Te-Se alloy or a carrier transportation layer is increased, thereby causing cracking. To prevent this, it is necessary to reduce the thickness of the overcoat layer, which decreases printing durability. To solve this problem, Japanese Patent Laid-Open No. 278858/1986 proposes that the overcoat layer have a two-layer structure and that the layer adjacent to the base layer have a lower arsenic concentration so as to serve as a buffer layer for the difference in the thermal expansion coefficient.

The object of the present invention is to enhance the effect of the above-described structure and to provide a selenium electrophotographic photoreceptor having long wavelength sensitivity, heat resistance, and improved printing durability.

SUMMARY OF THE INVENTION

To achieve this aim, the present invention provides a selenium electrophotographic photoreceptor comprising a laminate of a conductive base, a carrier transportation layer consisting of amorphous selenium or an amorphous Se-Te alloy, a carrier generation layer consisting of an amorphous Se-Te alloy containing 20 to 50 wt % of Te, and an overcoat layer composed of two layers consisting of Se-As alloys having different arsenic concentrations and different thicknesses. In one embodiment of the invention, the lower overcoat layer contains 2–10% by weight arsenic while the upper overcoat layer contains 10–30% by weight arsenic. In another embodiment of the invention, the lower overcoat layer has a lower arsenic content than the upper overcoat layer, and the thickness of the upper overcoat layer is greater than that of the lower overcoat layer but not more than 8 μm.

DETAILED DESCRIPTION OF THE INVENTION

According to the present invention, the overcoat layer of a function separation type selenium electrophotographic photoreceptor is composed of an upper overcoat layer having a high arsenic concentration and a lower overcoat layer having a low arsenic concentration, the thicknesses of the upper and lower overcoat layers being different. These features prevent cracking caused by a difference in the thermal expansion coefficients of the upper overcoat layer and the base layer. It is possible to enhance the printing durability of the photoreceptor by making the upper overcoat layer thicker than the lower overcoat layer, but not more than 8 μm to avoid deterioration in printing quality.

By increasing the arsenic concentration to 10–30% by weight in the upper overcoat layer and 2–10% by weight in the lower overcoat layer, the upper overcoat layer may have a smaller thickness than the lower overcoat layer, thereby enhancing the printing durability as well as the printing quality.

The following non-limiting examples are designed to further illustrate the claimed invention.

EXAMPLE 1

Figure 1A:
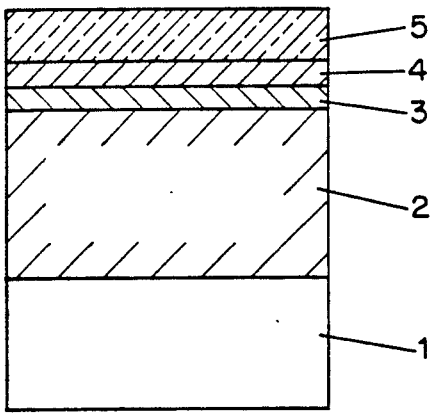
FIGS. 1(*a*) and 1(*b*) are schematic sectional views of a photoreceptor according to one embodiment the present invention, and a comparative example of a photoreceptor, respectively.
Figure 1B:
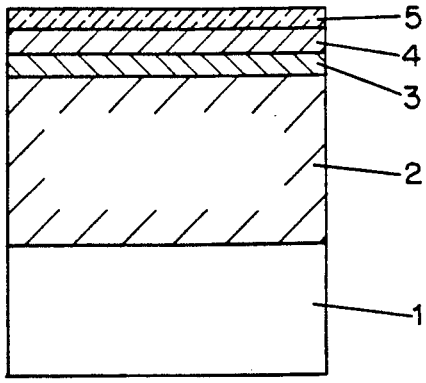
Figure 2:
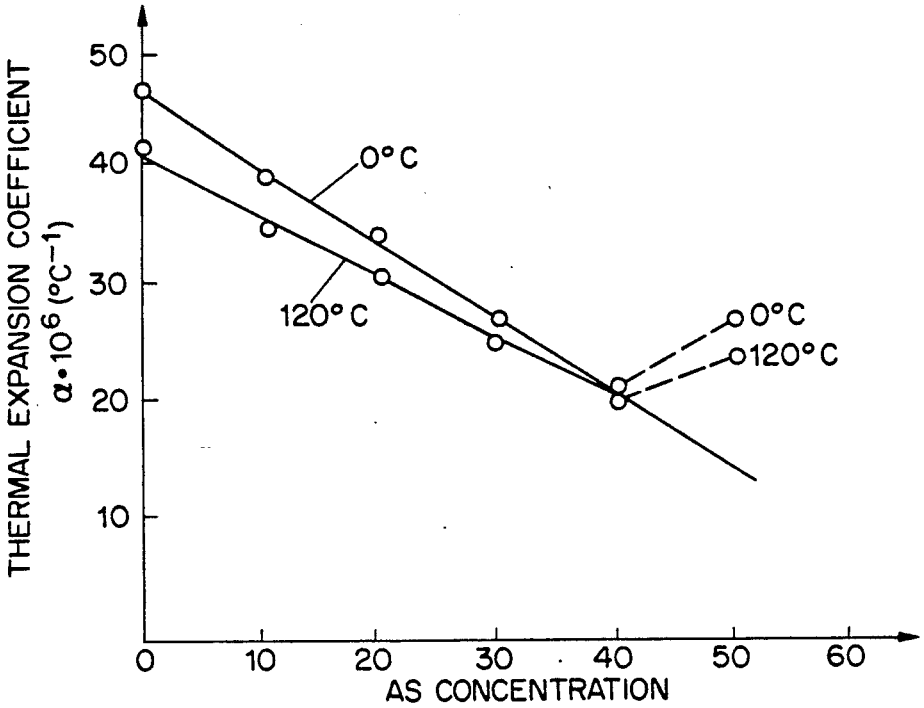
FIG. 2 shows the relationship between arsenic concentration and the thermal expansion coefficient of an Se-As alloy.

FIGS. 1(*a*) and (*b*) are sectional views of a first embodiment of a photoreceptor according to the present invention and a first comparative example of a photoreceptor, respectively. They were prepared as follows: an aluminum cylinder having a diameter of 120 mm was washed and mounted on the support shaft of an evaporation apparatus. While maintaining the temperature of the conductive base (1) at about 70° C., the apparatus was evacuated to $1\times10^{-5}$ Torr. The evaporation source containing pure selenium was heated to about 300° C., thereby depositing a carrier transportation layer (2) having a thickness of about 50 μm. Thereafter, by flash deposition, a carrier generation layer (3) of 44 wt % Te-Se alloy was deposited to a thickness of about 0.5 μm, a lower overcoat layer (4) of 1.5 wt % As-Se alloy was next deposited to a thickness of about 2 μm, and finally an upper overcoat layer (5) of 4 wt % As-Se alloy was deposited to a thickness of about 3 μm in the case of the first embodiment shown in FIG. 1(*a*), and about 1 μm in the case of the first comparative example shown in FIG. 1(*b*). The conditions for the flash deposition were as follows: The temperature of the support shaft was 60° C., the pressure was $1\times10^{-5}$ Torr, and the temperature of the evaporation source was 350° C.

Figure 3:
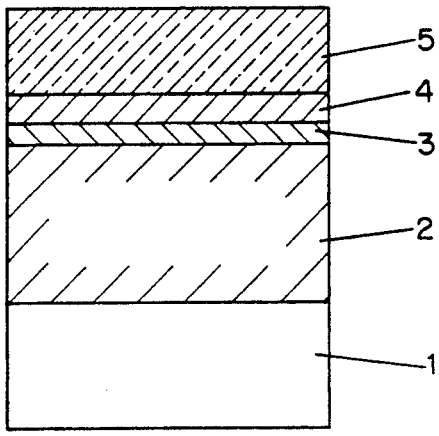
FIGS. 3 and 4 are schematic sectional views of other embodiments of a photoreceptor according to the present invention.
Figure 4:
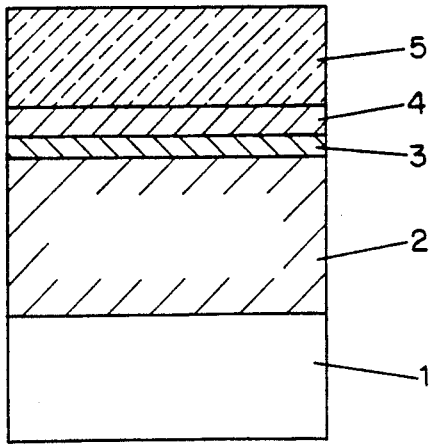

As a second embodiment, a photoreceptor in which the thickness of the upper overcoat layer (5) was about 6 μm, and as a third embodiment, a photoreceptor in which the thickness of the upper overcoat layer (5) was about 8 μm, were produced, as shown in FIGS. 3 and 4, respectively. Both the materials and thicknesses of the base (1), the charge transportation layer (2), and the lower overcoat layer (4) were the same as those of the first embodiment and the first comparative example. The evaporating conditions for each layer including the upper overcoat layer (5) were also the same.

Figure 5:
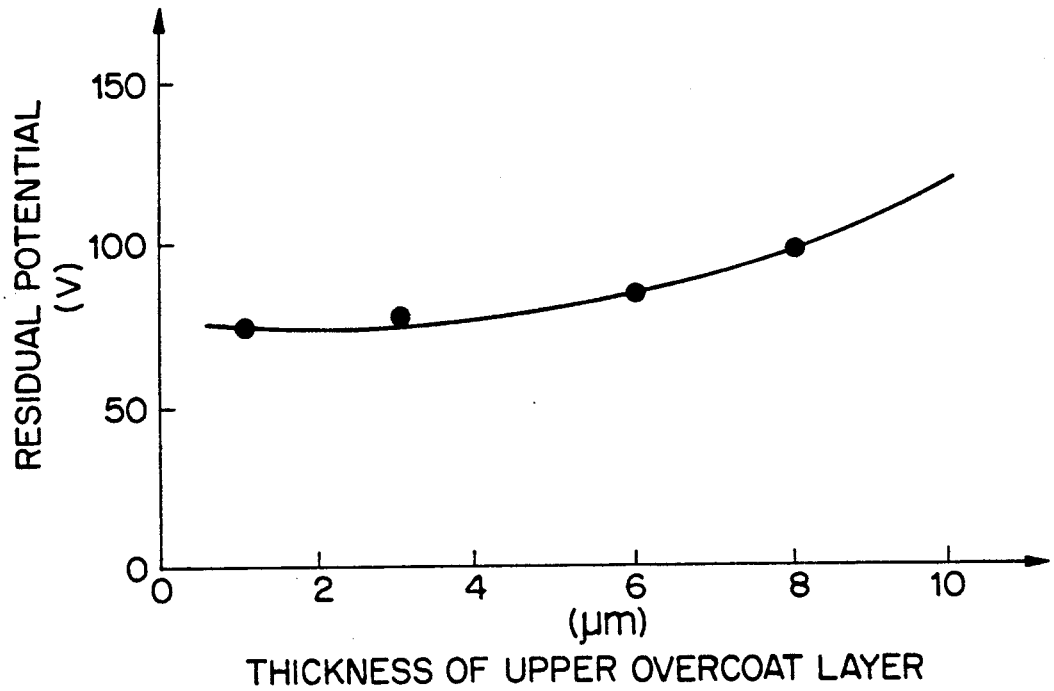
FIG. 5 shows the relationship between the thickness of the upper overcoat layer and the residual potential in one embodiment of the present invention and the comparative example.

The repetitive properties, printing durabilities and external appearances of these photoreceptors were compared. As to the repetitive properties, the reduction in charging, which causes photographic fog in printing, and the rise in the residual potential, which lowers the printing density, were evaluated. All the photoreceptors were at the same level in the reduction in charging. The residual potential had a tendency to increase as the thickness of the upper overcoat layer (5) became larger, as indicated by the value after 250 cycles in FIG. 5. When the thickness of the upper overcoat layer (5) exceeded 8 μm, the residual potential became 100 V or more, resulting in a reduction in the printing density.

Figure 6:
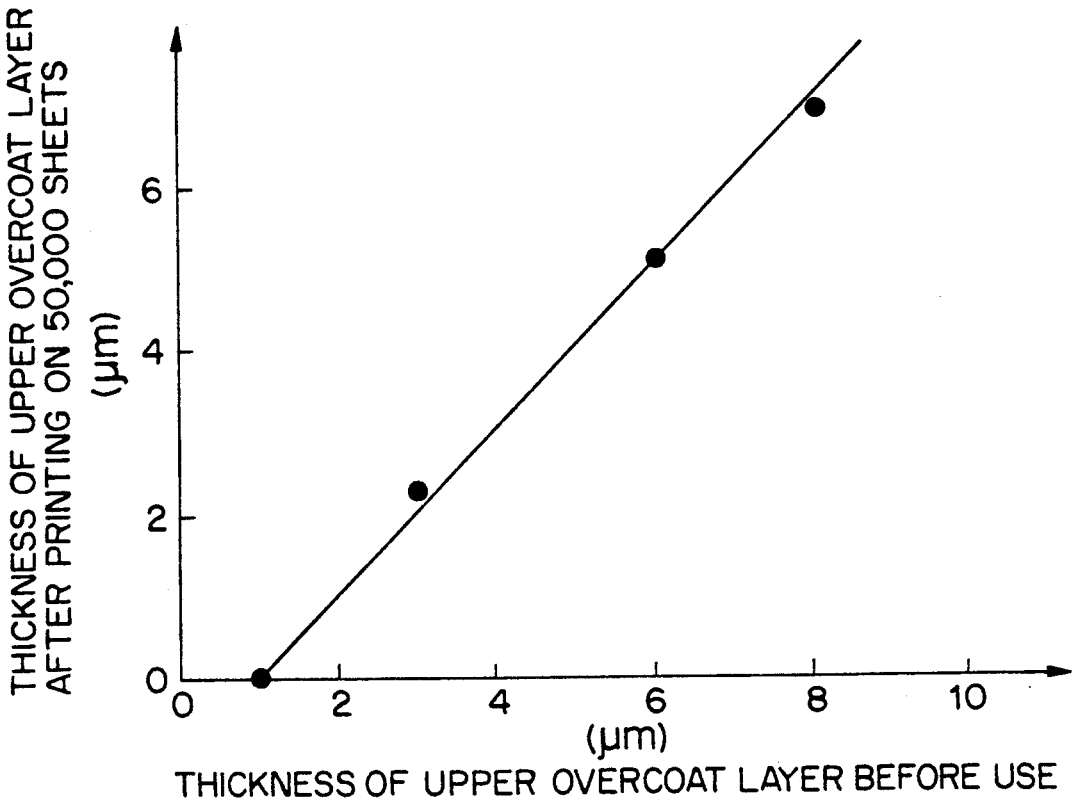
FIG. 6 shows the relationship between the thickness of the upper overcoat layer before and after printing 50,000 sheets.

In order to evaluate the printing durability, after printing had been made on 50,000 sheets of A4 paper by using a laser diode printer of a reversal development system, the thickness of the upper overcoat layer (5) was measured. The results are shown in FIG. 6. The larger the original thickness of the upper overcoat layer (5), the larger the thickness of the residual upper layer, in other words, the longer the printing life. These evaluations are collectively shown in Table 1, in which O denotes superior, Δ denotes acceptable and X denotes inferior.

TABLE 1

| | External Appearance | Repetitive Properties: Reduction In charge | Repetitive Properties: Residual Potential | Printing Durability | Evaluation |
|---|---|---|---|---|---|
| First Embodiment | O | O | O | Δ | O |
| Second Embodiment | O | O | O | O | O |
| Third Embodiment | O | O | Δ | O | Δ |
| First Comparative Example | O | O | O | X | X |

EXAMPLE 2

Two photoreceptors (fourth and fifth embodiments below) in accordance with the claimed invention were prepared as follows. An aluminum cylinder having a diameter of 80 mm was cleaned and installed on the support shaft of an evaporation apparatus as a conductive base. While maintaining the temperature of the conductive base at about 60° C., the apparatus was evacuated to $1\times10^{-5}$ Torr. The evaporation source containing pure selenium was heated to about 300° C., and a carrier transportation layer having a thickness of about 60 μm was deposited on the conductive base. Next, by flash deposition, a carrier generation layer comprising a Te-Se alloy containing 46% by weight Te was deposited thereon. Finally, the lower overcoat layer and upper overcoat layer of a surface protective layer were deposited on the carrier generation layer.

In the fourth embodiment, the lower overcoat layer comprised an As-Se alloy containing about 4% by weight As and had a thickness of about 2 μm, while the upper overcoat layer comprised an As-Se alloy containing about 15% by weight As and had a thickness of about 1 μm.

In the fifth embodiment, the lower overcoat layer comprised an As-Se alloy containing 40% by weight As and was about 2 μm thick. The upper overcoat layer of this photoreceptor comprised an As-Se alloy containing 25% by weight As and was about 1 μm thick. The lower and upper overcoat layers were formed by evaporation at a temperature of 60° C.

For comparison, three further comparative examples (second, third and fourth comparative examples) were prepared. The second comparative example was prepared in the same manner as the fourth and fifth embodiments above, however, the upper overcoat layer in the second comparative example contained 35% by weight As.

The third comparative example was also prepared in the same manner, however, the lower overcoat layer contained 2% by weight As and the upper overcoat layer contained 5% by weight As.

Finally, the fourth comparative example was also prepared in the same manner, however, the lower overcoat layer contained 2% by weight As and had a thickness of about 4 μm and the upper overcoat layer contained about 5% by weight As and had a thickness of about 2 μm.

The fourth and fifth embodiments and the second, third and fourth comparative examples were compared by measuring their surface hardness (Vickers hardness meter) to evaluate their printing proofness, and by examining their external appearances (the photoreceptors were checked for cracks after standing at 25° C.–45° C. for 1000 hours). The results of these comparisons are shown in Table 2. Again, 0 denotes superior and X denotes inferior.

TABLE 2

| | Surface hardness (kg/mm²) | Film thickness (μm) | Estimated print proof sheet no. (× 10,000 sheets) | External appearance 25° C. | External appearance 45° C. |
|---|---|---|---|---|---|
| Fourth Embodiment | 60 | 3 | 15 | 0 | 0 |
| Fifth Embodiment | 80 | 3 | 20 | 0 | 0 |
| Second Comparative Example | 130 | 3 | 50 | 0 | X |
| Third Comparative Example | 40 | 3 | 10 | 0 | 0 |
| Fourth Comparative Example | 40 | 6 | 15 | 0 | 0 |

These results indicate that although surface hardness is enhanced and the printing proofness is improved by increasing the As content in the upper overcoat layer, when the As content exceeds 30% by weight, cracks are generated at high temperatures. On the other hand, when the upper overcoat layer contains less than 10% by weight As, electric resistance rises and the luster of the photoreceptor surface vanishes.

Applicants have found that photoreceptors according to the claimed invention have virtually the same initial electric characteristics and printing characteristics as conventional photoreceptors employing higher amounts of As. Yet, the generation of cracks is avoided with applicants' two-layer surface protective layer containing different amounts of As.

We claim:

1. A selenium electrophotographic photoreceptor comprising a laminate of a conductive base, a charge transportation layer consisting of a material selected from the group consisting of amorphous selenium and an amorphous selenium-tellurium alloy, a carrier generation layer consisting of an amorphous selenium-tellurium alloy containing 20 to 50% by weight of tellurium, a lower overcoat layer adjacent to said carrier generation layer consisting of a selenium-arsenic alloy, and an upper overcoat layer consisting of a selenium-arsenic alloy, wherein the lower overcoat layer and upper overcoat layer have different arsenic concentrations and different thicknesses.

2. A selenium electrophotographic photoreceptor comprising a laminate of a conductive base, a charge transportation layer consisting of a material selected from the group consisting of amorphous selenium and an amorphous selenium-tellurium alloy, a carrier generation layer consisting of an amorphous selenium-tellurium alloy containing 20 to 50% by weight of tellurium, a lower overcoat layer adjacent to said carrier generation layer consisting of a selenium-arsenic alloy, and an upper overcoat layer consisting of a selenium-arsenic alloy, wherein the lower overcoat layer has a lower arsenic content than the upper overcoat layer, and the thickness of the upper overcoat layer is greater than that of the lower overcoat layer and not more than 8 μm.

3. A selenium electrophotographic photoreceptor comprising a laminate of a conductive base, a charge transportation layer consisting of a material selected from the group consisting of amorphous selenium and an amorphous selenium-tellurium alloy, a carrier generation layer consisting of an amorphous selenium-tellurium alloy containing 20 to 50% by weight of tellurium, a lower overcoat layer adjacent to said carrier generation layer consisting of a selenium-arsenic alloy containing 2–10% by weight arsenic, and an upper overcoat layer consisting of a selenium-arsenic alloy containing 10–30% by weight arsenic.

4. The photoreceptor according to claim 3, wherein the thickness of the upper overcoat layer is smaller than that of the lower overcoat layer.

5. A selenium electrophotographic photoreceptor comprising a laminate of a conductive base, a charge transportation layer consisting of a material selected from the group consisting of amorphous selenium and an amorphous selenium-tellurium alloy, a carrier generation layer consisting of an amorphous selenium-tellurium alloy containing 20to 50% by weight of tellurium, and an overcoat layer consisting essentially of a lower overcoat layer adjacent to said carrier generation layer consisting of a substantially homogeneous selenium-arsenic alloy having a first arsenic concentration, and an upper overcoat layer consisting of a selenium-arsenic alloy having a second arsenic concentration, wherein the lower overcoat layer and upper overcoat layer have different arsenic concentrations and different thicknesses.

* * * * *